US009731544B2

(12) United States Patent
Huffman

(10) Patent No.: US 9,731,544 B2
(45) Date of Patent: Aug. 15, 2017

(54) AUTOGRAPH BALL WITH REMOVABLE WRITING UTENSIL

(71) Applicant: In The Ball, LLC, Evansdale, IA (US)

(72) Inventor: Andrew Lee Huffman, Waterloo, IA (US)

(73) Assignee: Andew Lee Huffman, Waterloo, IA (US)

( * ) Notice: Subject to any disclaimer, the term of this patent is extended or adjusted under 35 U.S.C. 154(b) by 0 days.

(21) Appl. No.: 14/997,612

(22) Filed: Jan. 18, 2016

(65) Prior Publication Data

US 2017/0203606 A1 Jul. 20, 2017

(51) Int. Cl.

| | |
|---|---|
| ***B43K 23/00*** | (2006.01) |
| ***B43K 7/00*** | (2006.01) |
| ***B43K 8/02*** | (2006.01) |
| ***A63B 43/00*** | (2006.01) |

(52) U.S. Cl.
CPC ..... *B43K 23/001* (2013.01); *A63B 43/00* (2013.01); *B43K 7/005* (2013.01); *B43K 8/02* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,650,570 | A * | 9/1953 | Voelcker | B43M 99/003 211/69.5 |
| 4,291,809 | A * | 9/1981 | Lyon | B43K 23/002 124/31 |
| 4,355,726 | A * | 10/1982 | Mutschler | B43M 99/007 211/69.5 |
| 4,533,058 | A | 8/1985 | Uhlig | |
| 4,798,310 | A | 1/1989 | Kasai et al. | |
| 6,736,429 | B1 | 5/2004 | Steeg | |

OTHER PUBLICATIONS

U.S. Appl. No. 14/331,766, filed Jul. 15, 2014.

* cited by examiner

*Primary Examiner* — David Walczak
(74) *Attorney, Agent, or Firm* — Nyemaster Goode, P.C.

(57) ABSTRACT

A sports implement for obtaining autographs, having a core, a hole in the core having an open end and a closed bottom end, a housing disposed within the hole further comprising a latch, a spring, and a stop rim. The implement further includes a cap rotatably and slidably disposed within the housing comprising a first position wherein the cap compresses the spring toward the closed bottom end and a second position wherein the spring urges the cap against the stop rim, and a writing utensil removably coupled with the cap and rotationally coupled with the housing, further comprising a striker selectively interfacing with the latch.

19 Claims, 6 Drawing Sheets

AUTOGRAPH BALL WITH REMOVABLE WRITING UTENSIL

BACKGROUND OF THE DISCLOSURE

Obtaining autographs from prominent sports figures is a pastime passed down from generation to generation. One of the items autograph seekers like to have autographed is the implement that the given sport utilizes in the game. For instance, baseball fans like to have a baseball or a bat autographed. Hockey fans may like to have a hockey puck or stick signed. Football or soccer fans may like to have the balls from those given sports autographed. But with the recent movement toward less access to the players or other figures, it becomes harder to get the sports implement and a writing utensil to the figure separately. What is disclosed is an apparatus to get both the item to be autographed and a writing utensil to the sports figure quickly and easily.

SUMMARY OF THE PRESENT DISCLOSURE

One aspect of the present disclosure includes an autograph baseball having a core, a skin substantially covering the core, a hole through the skin and into the core having a closed bottom end, a housing fixed within the hole comprising a latch and a cylindrical recess, a cap comprising an upper portion and a body slidably disposed within the cylindrical recess, a spring disposed in the cylindrical recess and having an end in contact with the body, a writing utensil rotatably mounted within the housing and removably coupled with the upper portion of the cap, the writing utensil further comprising a striker configured to selectively interface with the latch.

Another aspect of the present disclosure includes a sports implement for obtaining autographs, which has a core, a hole in the core having an open end and a closed bottom end, a housing disposed within the hole further comprising a latch, a spring, and a stop rim, a cap rotatably and slidably disposed within the housing comprising a first position wherein the cap compresses the spring toward the closed bottom end and a second position wherein the spring urges the cap against the stop rim, a writing utensil removably coupled with the cap and rotationally coupled with the housing, further comprising a striker selectively interfacing with the latch.

Yet another aspect of the present disclosure includes A piece of sporting equipment with a removable writing utensil for obtaining autographs, having a core, a hole in the core comprising a stop rim, an open end, and a closed bottom end, a housing fixed within the hole and comprising an elastic element, a stop rim, and a latch element, a elastic element having a distal end in contact with the closed bottom end and a second end, a cap in contact with the second end rotatably and slidably disposed within the hole comprising a first position wherein the cap compresses the elastic element toward the closed bottom end and a second position wherein the elastic element is flexed and the cap is urged against the stop rim. It further includes a writing utensil removably coupled with the cap comprising a striker, a cover, a striker body portion, a first body portion, a second body portion, and comprising at least four positions: a. an inserted position wherein writing utensil is in a compressed state, the cap is in the first position and the writing utensil is removably coupled with the cap; b. a rotated position wherein the writing utensil has been rotated such that the striker is free of the latch element, the cap is in the second position, and the cover sticks out of the open end a distance approximately a half inch; c. an extended position wherein the writing utensil is extended fully, the cap is in the second position, and the writing end remains coupled with the cap; and d. a removed position wherein the writing utensil is fully extended and is removed from the piece of sporting equipment.

These and other aspects, objects, and features of the present disclosure will be understood and appreciated by those skilled in the art upon studying the following specification, claims, and appended drawings.

DETAILED DESCRIPTION OF EMBODIMENTS

Figure 1:
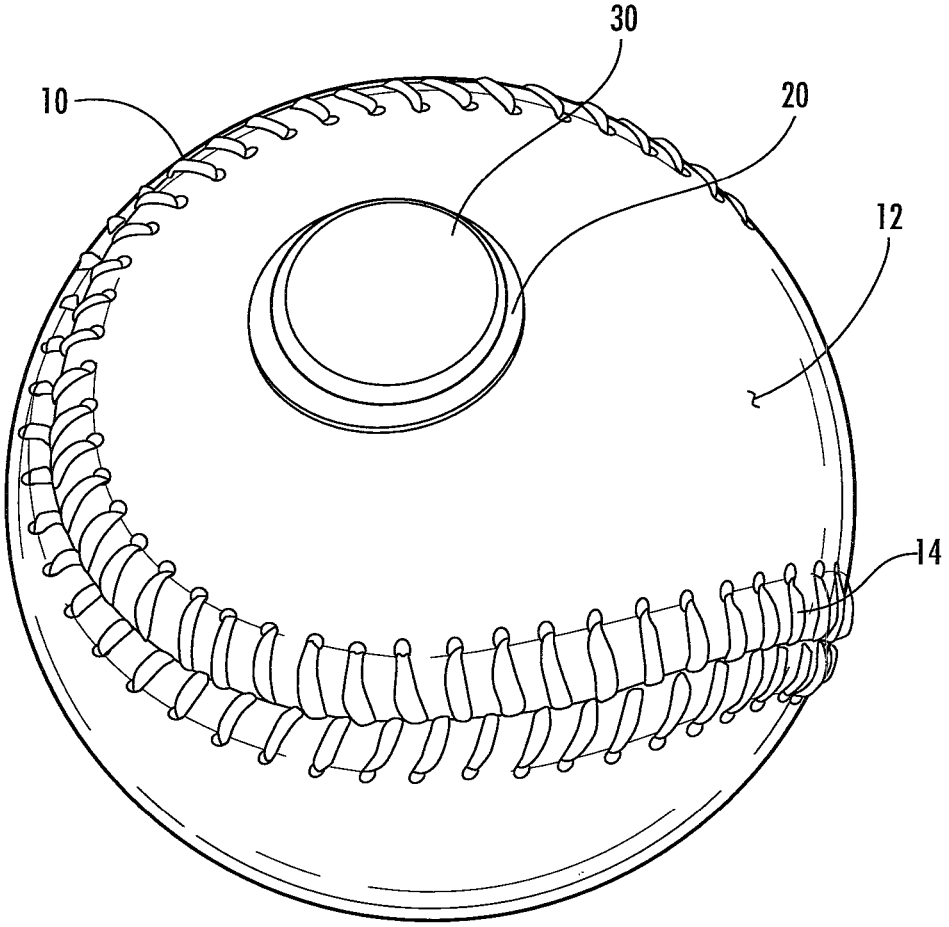
FIG. 1 is an isometric view of the Autograph baseball.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

FIG. 1 generally shows an isometric view of the autograph ball 10 showing the laces 14 of a baseball with the top of a sleeve 20 showing outside the skin 12 of the baseball and a writing utensil 30 inserted into the sleeve 20 with a cover 32 sticking outside of the sleeve. FIG. 1 generally shows the writing utensil 30 in a compressed state, which will be described in more detail below.

Figure 2:
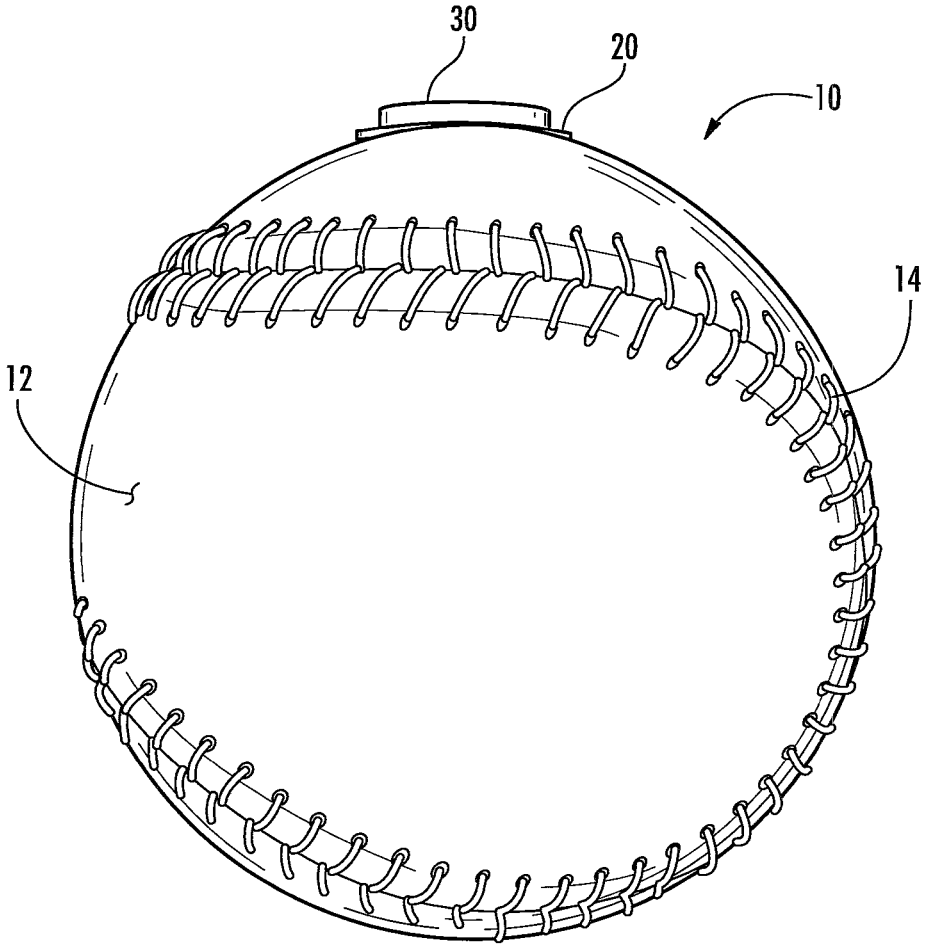
FIG. 2 is a side view of the autograph baseball.
Figure 3:
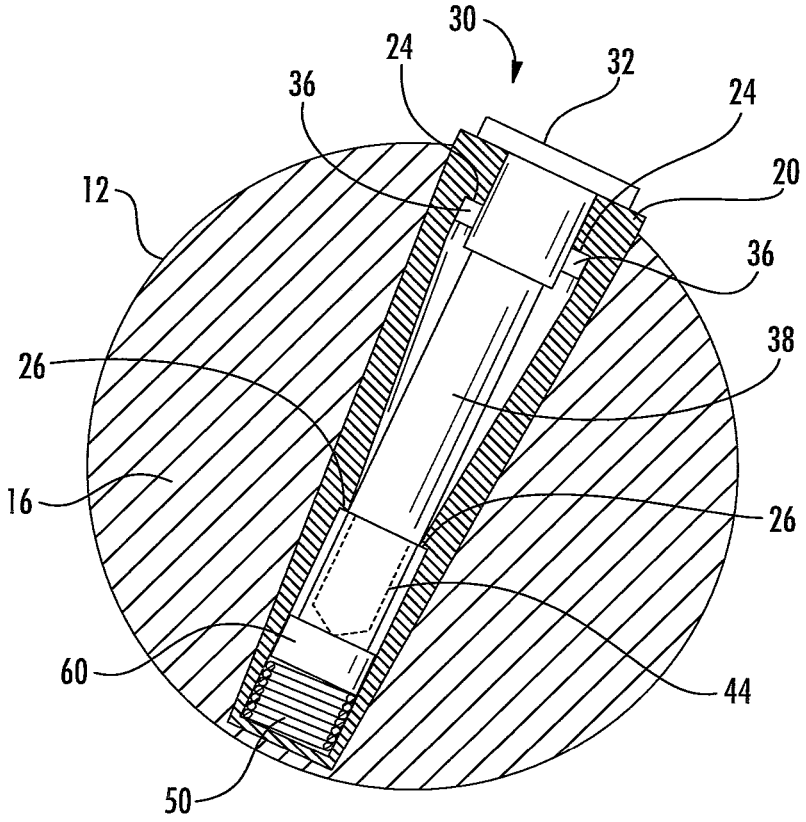
FIG. 3 is a cross-section of the autograph baseball showing the pen in the compressed and inserted state.

FIG. 2 further shows a side view of the autograph ball 10 showing the sleeve 20 and the writing utensil 30 protruding slightly from the general shape of the baseball. FIG. 3 shows a cross-section of the autograph ball 10 as will be described in detail in the following. As shown in FIG. 3, the ball has a core 16 which is covered by a skin 12. The core 16 and skin 12 are the typical materials used in baseball manufacturing, in order to replicate the weight and feel of a ball suitable for use in baseball. A hole may be drilled through the skin 12 and into the core 16, wherein the hole goes into but not through core and out the other side of the ball.

Inserted into the ball 10 is a sleeve 20. The sleeve as shown in FIG. 3 may be a single piece, generally of plastic, but may also be any other material suitable for a press fit into material such as the core of a baseball. The sleeve 20 may also be two separate pieces that are mated together before being inserted into the core 16. Preferably the sleeve 20 is injection molded in two halves which are then mated and connected together using tape, glue, sonic welding, or any other connection known in the art. Once the two pieces are fit together the sleeve 20 may be put in a press (not shown) and press fit into the core. The required press size may be between about 80 pounds pressure to about 150 pounds pressure, preferably about 100 pounds pressure in order to have enough pressure to keep the sleeve 20 in the core 16, but not damage the ball 10.

Figure 4:
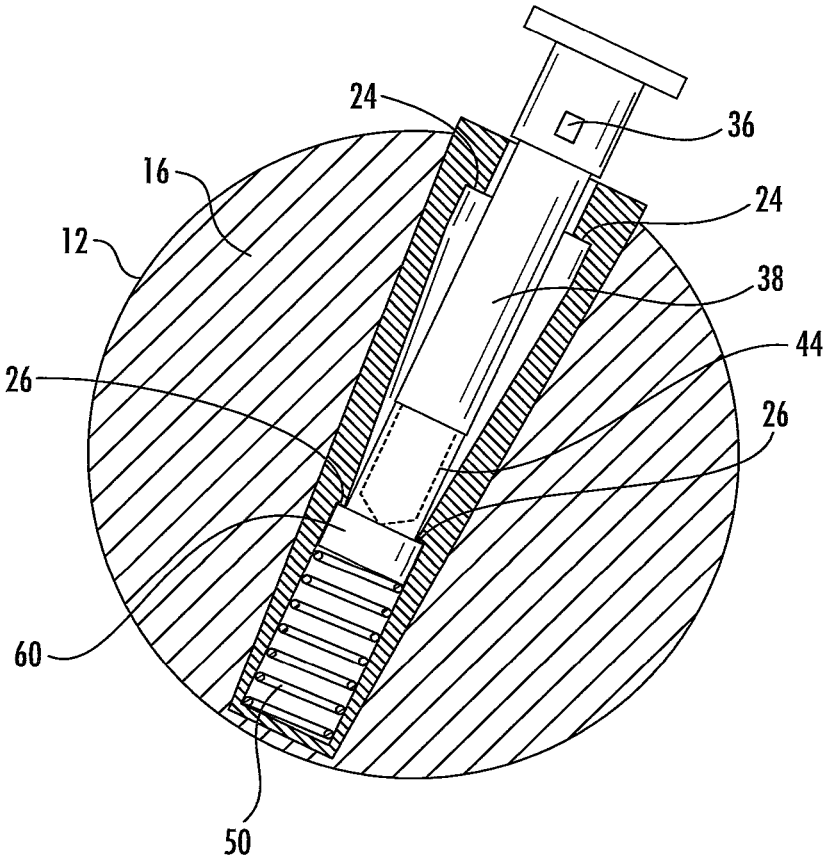
FIG. 4 is a cross-section showing the pen in the compressed state at the beginning of the removal process.

Before the two pieces of the sleeve 20 are connected together a spring 50 may be placed at the bottom of the sleeve 20. A cap 60 may be placed on top of the spring 50 and the two pieces of the sleeve 20 may be brought together and connected in the above described fashion and the spring 50 and cap 60 may be held in place by a stop rim 26 molded into the sleeve 20. When assembled, the cap 60 has a first position (as shown in FIG. 3) where it is urged against the end of the sleeve 20 and the spring 50 is compressed, and a second position (as shown in FIG. 4) where there is no force acting downwardly on the cap 60 and the spring 50 urges the cap 60 against the stop rim 26 of the sleeve 20 and holds it against the stop rim 26. With the spring 50 and cap 60 in place the two halves of the sleeve 20 may be coupled and connected in any of the fashions described above, and this assembly is then inserted into the ball using a press as described above. A writing utensil 30, which is generally a pen or marker able to mark legibly on a baseball, may then be presented to the ball 10. The writing utensil 30 may have an end 44 that fits within the cap 60 by an interference fit. This interference fit allows the writing utensil 30 to be held in the ball 10, without the writing utensil 30 to be removed without some additional force. The cap 60 may be able to rotate in the sleeve 20, which also allows the writing utensil 30 to rotate within the ball 10.

The writing utensil 30 may include a striker portion 34 (see FIG. 5) which further includes the striker 36. The writing utensil 30 preferably includes two strikers 36. The sleeve 20, at the top, may include a one or more latch flanges 24. The latch flanges 24 may have an inner radius r2 that protrudes into the inner radius r1 (see FIG. 7) of the sleeve 20 by anywhere from an eighth of an inch to a quarter of an inch. The latch flanges 24 leave enough room between them to allow the strikers 36 to bypass them as the writing utensil 30 is being inserted or removed from the ball 10. The writing utensil cover 32 including the striker portion 34 which includes the strikers 36 may then be rotated such that the strikers 36 interfere with the latch flanges 24 and are therefore unable to be removed from the ball 10 without again rotating the strikers 36 to the spaces between the latch flanges 24.

Figure 5:
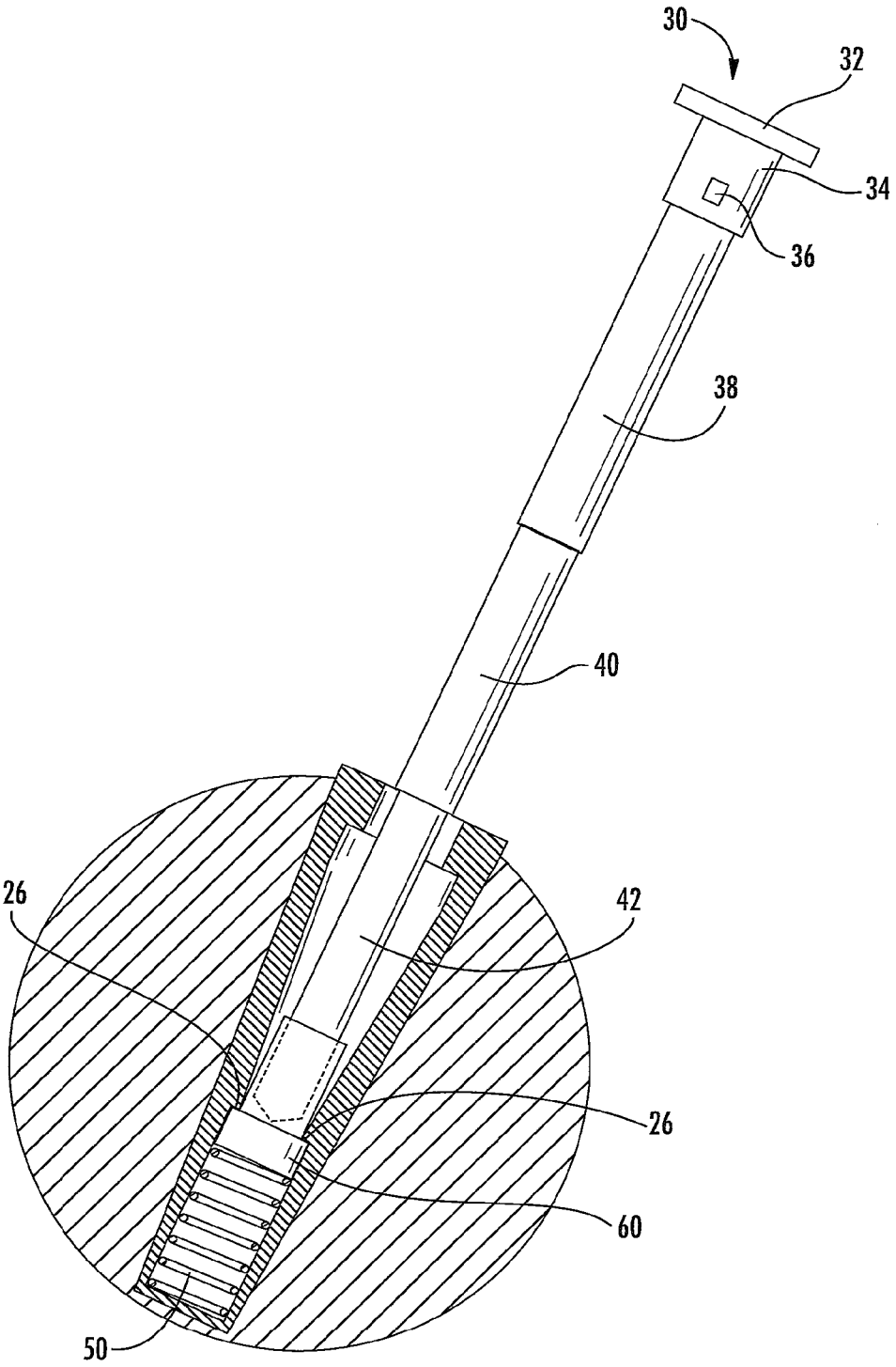
FIG. 5 is a cross-section showing the pen in the extended state, as the pen is being removed for use.
Figures 6, 7:
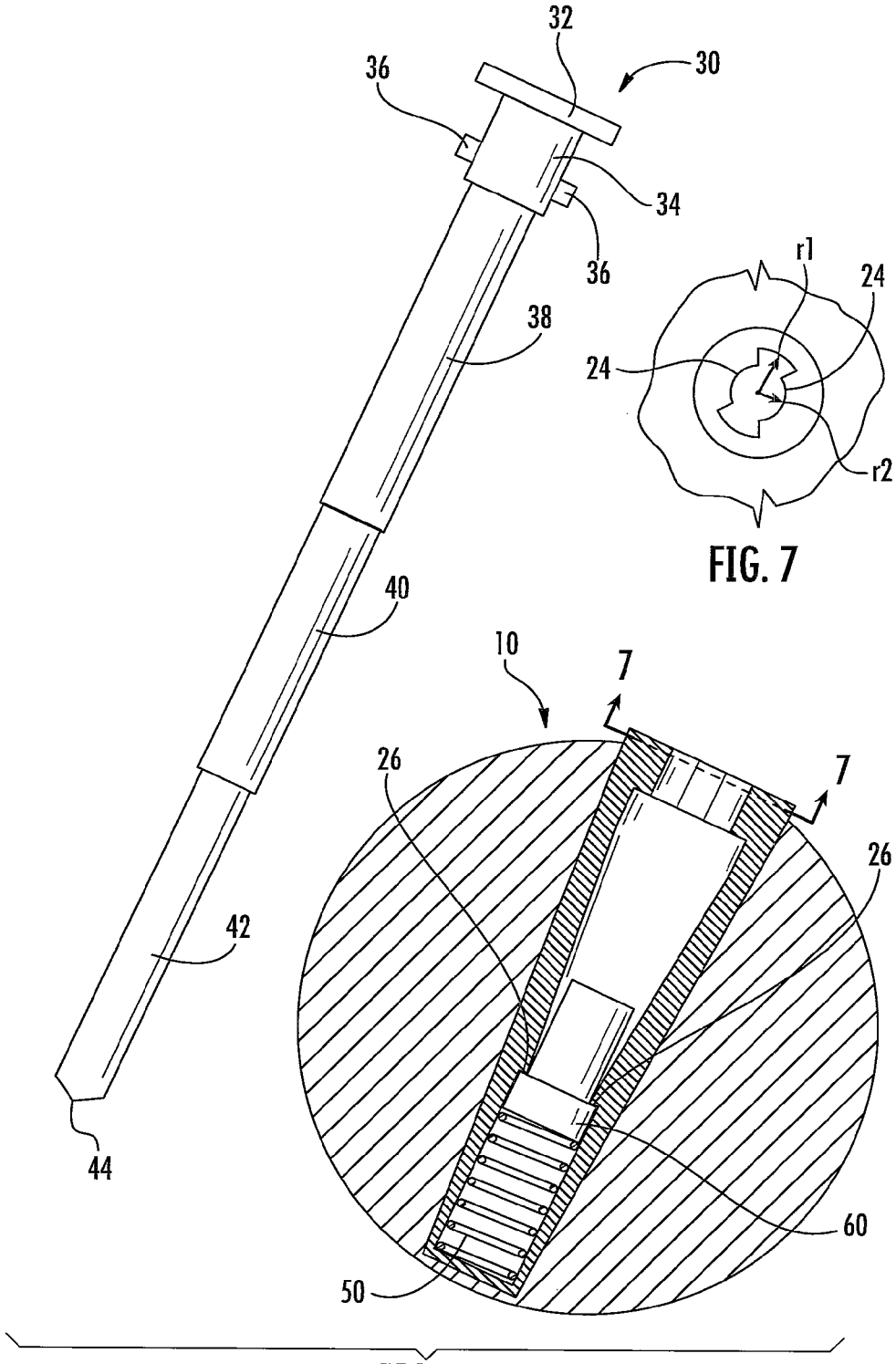
FIG. 6 shows a cross-section of the ball with the pen completely removed for use.
FIG. 7 shows a cross-section of the top of the sleeve showing the detail of the latch flanges.

FIGS. 4-6 illustrate how the writing utensil 30 may be removed from the ball 10. As shown in FIG. 4, When a user would like to remove the writing utensil 30 from the ball 10 the cover 32 is rotated, generally about 90°, such that the strikers 36 are no longer interfering with the latch flanges 24. The spring 50 then urges the cap 60 up and toward the open end of the sleeve 20 which urges the writing utensil 30 in the same direction and the cover 32 and striker portion 34 are protrude from the top of the sleeve 20 by a distance substantial enough for a user to grab the cover 32 and pull the writing utensil 30 out. This distance that the cover 32 sticks out may be a quarter of an inch to three quarters of an inch, more preferably about a half inch.

As shown in detail in FIG. 5, a user then begins to pull the writing utensil 30 out of the ball 10, and extends the writing utensil 30 into its extended position. The writing utensil 30 further includes a first portion 38 a second portion 40 and third portion 42, the third portion further including the tip 44. The first, second, and third portions 38, 40, 42 are created such that the writing utensil 30 may be compressed and the portions collapse upon themselves. When the writing utensil 30 is in the collapsed position it may be two inches to two and a quarter inches, more preferably two inches to two and an eighth inches. The distance must be such that when the writing utensil 30 is inserted into the ball 10 it must not exceed the diameter of the ball 10 when combined with the spring 50, the cap 60, and the end portion of the sleeve 20. When the writing utensil 30 is removed from the ball the third portion 42 remains in contact with the cap 60 via the interference fit and the first, second, and third portions 38, 40, 42 are then extended out to an extended state. The extended state of the writing utensil may be four and a half inches to five inches, more preferably four and a half inches.

As shown in FIG. 6, a user may then remove the writing utensil 30 from the cap 60 such that the writing utensil 30 may be used to autograph the ball 10. After the writing utensil 30 is used to mark the ball, the writing utensil 30 may then be reinserted into the ball to be returned to the user, by inserting the pen 30 into the ball, urging the third portion into the cap 60, compressing the spring 50, compressing the pen 30 into the compressed state, and then rotating the striker portion 34 such that the striker or strikers 36 interfere with the latch flanges 24.

The sleeve 20, spring 50, cap 60, and writing utensil 30 may also be insertable into other sports implements. These may include, but are not limited to, a hockey puck, a football, a soccer ball, a basketball, and a volleyball. The design for a hockey puck would be similar to what is shown in FIG. 3, but without the skin 12. Because a hockey puck's material is homogenous in nature, there is no skin. In the case of a ball that needs to be inflated to be used, a foam may be inserted into the ball. This foam may be of such material that provides enough resistance on the ball to allow a user to sign it using the writing utensil 30, and also provide enough strength to hold the sleeve 20 in place via the press fit. The foam may take the place of the air in the sports implement, such that no air needs to be inserted into the ball. The foam is inserted into the skin of the ball which is of a material similar to the actual ball that may be used in the given sport, and the foam offers the resistance and the proper feel of the sports implement.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. An autograph baseball, comprising:

a core;

a skin substantially covering the core;

a hole through the skin and into the core having a closed bottom end;

a housing fixed within the hole comprising a latch and a cylindrical recess;

a cap comprising an upper portion and a body slidably disposed within the cylindrical recess;

a spring disposed in the cylindrical recess and having an end in contact with the body;

a writing utensil rotatably mounted within the housing and removably coupled with the upper portion of the cap, the writing utensil further comprising a striker configured to selectively interface with the latch.

2. The autograph baseball of claim 1, wherein the writing utensil is removable from the upper portion of the cap without the use of tools.

3. The autograph baseball of claim 1, wherein the writing utensil further comprises a first body portion, a second body portion, and a third body portion.

4. The autograph baseball of claim 3, wherein the first body portion is slidably coupled with the second body portion, and the second body portion is slidably coupled with the first body portion.

5. The autograph baseball of claim 4, wherein the writing utensil has an extended state and a compressed state.

6. The autograph baseball of claim 5, wherein the writing utensil has a length of approximately 2⅛ inches in the compressed state, and approximately 4½ inches in the extended state.

7. The autograph baseball of claim 5, wherein the first, second, and third body portions are substantially contained within the hole when the writing utensil is both in the compressed state and coupled with the upper portion of the cap.

8. The autograph baseball of claim 1, wherein the writing utensil further comprises a cover and a striker body portion, wherein the striker is disposed on the striker body portion.

9. The autograph baseball of claim 8, wherein the housing has an inner radius and the latch comprises a flange that extends inside the inner radius.

10. The autograph baseball of claim 9, wherein the striker is configured to interface with the flange to prevent the removal of the writing utensil, and wherein the striker is configured to clear the flange when rotated approximately 90 degrees.

11. A sports implement for obtaining autographs, comprising:

a core;

a hole in the core having an open end and a closed bottom end;

a housing disposed within the hole further comprising a latch, a spring, and a stop rim;

a cap rotatably and slidably disposed within the housing comprising a first position wherein the cap compresses the spring toward the closed bottom end and a second position wherein the spring urges the cap against the stop rim;

a writing utensil removably coupled with the cap and rotationally coupled with the housing, further comprising a striker selectively interfacing with the latch;

wherein the writing utensil further comprises a first body portion, a second body portion, and a third body portion, and wherein the first body portion is slidably coupled with the second body portion, and the second body portion is slidably coupled with the first body portion.

12. The sports implement of claim 11, wherein the sports implement is one of a baseball and a hockey puck.

13. The sports implement of claim 12, wherein the core is substantially the same as a core of the sports implement.

14. The sports implement of claim 11, further comprising a skin over the core, wherein the sports implement is one of a basketball, a soccer ball, a football, and a volleyball.

15. The sports implement of claim 14, wherein the core substantially comprises a foam material that is substantially inflexible to resist the pressure of the writing utensil when writing on the skin of the sports implement.

16. The autograph baseball of claim 11, wherein the first, second, and third body portions are substantially contained within the hole when the writing utensil is both in the compressed state and coupled with the upper portion of the cap.

17. The autograph baseball of claim 11, wherein the housing has an inner radius and the latch comprises a flange that extends inside the inner radius.

18. The autograph baseball of claim 17, wherein the striker is configured to interface with the flange to prevent the removal of the writing utensil, and wherein the striker is configured to clear the flange when rotated approximately 90 degrees.

19. A piece of sporting equipment with a removable writing utensil for obtaining autographs, comprising:

a core;

a hole in the core comprising an open end, and a closed bottom end;

a housing fixed within the hole and comprising an elastic element, a stop rim, and a latch element;

a elastic element having a distal end in contact with the closed bottom end and a second end;

a cap in contact with the second end rotatably and slidably disposed within the hole comprising a first position wherein the cap compresses the elastic element toward the closed bottom end and a second position wherein the elastic element is flexed and the cap is urged against the stop rim;

a writing utensil removably coupled with the cap comprising a striker, a cover, a striker body portion, a first body portion, a second body portion, and comprising at least four positions:

a. an inserted position wherein writing utensil is in a compressed state, the cap is in the first position and the writing utensil is removably coupled with the cap;

b. a rotated position wherein the writing utensil has been rotated such that the striker is free of the latch element, the cap is in the second position, and the cover sticks out of the open end a distance approximately a half inch;

c. an extended position wherein the writing utensil is extended fully, the cap is in the second position, and the writing end remains coupled with the cap; and d. a removed position wherein the writing utensil is fully extended and is removed from the piece of sporting equipment.

* * * * *